United States Patent [19]

Fitzgerald-Smith et al.

[11] 4,143,439

[45] Mar. 13, 1979

[54] BRIDGE REINFORCEMENTS

[75] Inventors: James P. Fitzgerald-Smith, Ossemsley, near New Milton; Derek I. Knight, Bournemouth, both of England

[73] Assignee: The Secretary of State for Defence in Her Britannic Majesty's Government of the United Kingdom of Great Britain and Northern Ireland, London, England

[21] Appl. No.: 879,996

[22] Filed: Feb. 22, 1978

[51] Int. Cl.[2] ..... E01D 9/00

[52] U.S. Cl. ..... 14/10; 14/17; 52/640

[58] Field of Search ..... 14/10, 17, 3; 52/640, 52/641, 222, 691

[56] References Cited

U.S. PATENT DOCUMENTS

| | | | |
|---|---|---|---|
| 530,425 | 12/1894 | Keating | 14/17 X |
| 1,467,662 | 9/1923 | Aalst | 52/226 |
| 1,813,338 | 7/1931 | Botel | 52/226 |
| 2,793,720 | 5/1957 | Hawes | 52/640 |
| 2,856,644 | 10/1958 | Dunham | 14/10 X |
| 3,362,117 | 1/1968 | Van Raden | 52/640 |
| 4,021,875 | 5/1977 | Abell | 14/10 |

FOREIGN PATENT DOCUMENTS

| | | | |
|---|---|---|---|
| 2324646 | 12/1974 | Fed. Rep. of Germany | 14/10 |

*Primary Examiner*—Nile C. Byers, Jr.
*Attorney, Agent, or Firm*—Pollock, VandeSande and Priddy

[57] ABSTRACT

This invention provides an improved reinforcement for a bridge span, the reinforcement including a reinforcing member for attachment in an underslung position to the span, a reinforcing strut adapted at its first end for pivotal connection to a point intermediate the ends of the reinforcing member and jacking means for urging the reinforcing strut into its working position in which the reinforcing member is under tension. The improvement resides in that the jacking means is adapted to be mounted upon the bridge span and, in use, exerts a force transverse to the longitudinal axis of the strut to urge it into said working position in which the strut is, at its point of connection to the member, inclined at acute angles to the member.

9 Claims, 2 Drawing Figures

BRIDGE REINFORCEMENTS

Figure 1:
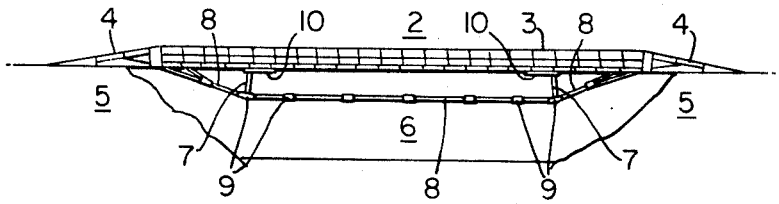

This invention relates to bridge reinforcements.

Bridge reinforcements in accordance with this invention are particularly suitable for use with the bridge spans of temporary bridges. It is particularly advantageous to provide reinforcement for such bridge spans since then the temporary bridge can support greater loads and consequently a stock of a single design of bridge span may be able to cope with most contingencies.

It has been proposed to reinforce a rectilineal bridge span of a temporary bridge by providing the span with an underslung reinforcing member and to tension the member by means of two similar reinforcing struts projecting normally from the span and connected to points on the member intermediate its two ends. However such a proposal suffers from the disadvantage that forces exerted on the points of the span where the member is attached are high and consequently the extent to which the span can be reinforced is limited. With such reinforcement it has been proposed to provide the reinforcing struts with jacking means for extending the length of the strut to tension the reinforcing member. Such a proposal suffers from the disadvantage that, since the member and strut are beneath the span, the jacking means is not readily accessible and is, when the bridge is to be laid across a river, liable to be submerged.

The present invention seeks to overcome the disadvantages of the aforesaid proposals by firstly, in such proposed bridge reinforcements, inclining the reinforcing struts such that when the member is under tension each strut is, at its point of connection to the member, inclined at acute angles to the member (thereby reducing the forces on the points of the span where the member is attached) and secondly, by providing jacking means, for urging the reinforcing strut into its working position, which exerts a force transverse to the longitudinal axis of the strut (and may thereby be mounted in a more accessible position than hitherto).

According to the present invention there is provided a bridge reinforcement for a bridge span, said reinforcement comprising:

(a) a reinforcing member for attachment in an underslung position to the span, (b) a reinforcing strut adapted at its first end for pivotal connection to a point intermediate to the ends of the reinforcing member, (c) jacking means for urging the reinforcing strut into its working position in which the reinforcing member is under tension, and wherein the improvement resides in that the jacking means is adapted to be mounted upon the bridge span and, in use, exerts a force transverse to the longitudinal axis of the strut to urge it into said working position in which the strut is, at its point of connection to the member, inclined at acute angles to the member.

It is preferable that, in use, the jacking means urges the strut to a working position in which said acute angles are equal.

Advantageously the jacking means has locking means for retaining the strut in its working position.

The jacking means may include a slideway and the strut may be provided at its second end with a cooperating slider block so that, in use, the strut is urged into its working position by the jacking means exerting a force upon the strut such that the second end is slideably moved while the strut pivots about its first end. The jacking means may further include a cable for attachment to said slider block and a jack for hauling in the cable to thereby, in use, slideably move said second end of the strut.

The reinforcing member may comprise a chain of rigid elongate members and advantageously may be provided with bifurcated ends.

This invention extends to a bridge including a bridge span reinforced with a bridge reinforcement in accordance with this invention. The bridge span may include a plurality of intermediate units joined in end to end relationship by unions. With such a bridge span and where the reinforcing member has bifurcated ends advantageously the member may be attached to the bridge span by each branch of the bifurcated end of the member being attached to a union. Conveniently the branches are attached to adjacent unions. Where the jacking means includes a slideway, the slideway may be mounted upon the bridge span by attachments to two adjacent unions.

Figure 2:
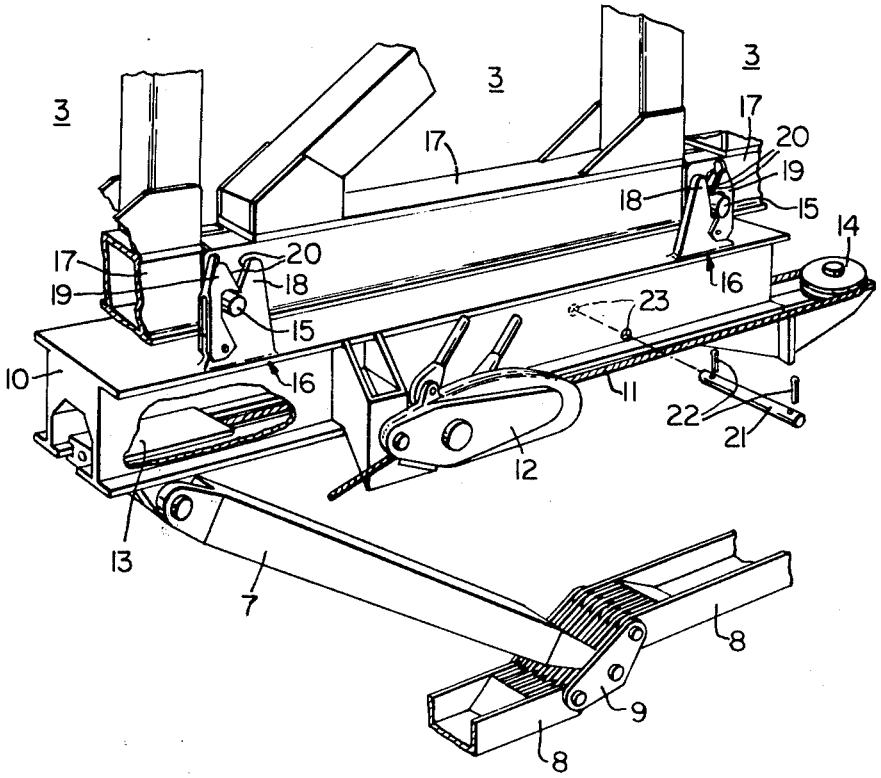

The invention will now be described by way of example only with reference to the accompanying drawings of which:

FIG. 1 shows, very diagrammatically, a bridge incorporating a bridge reinforcement in accordance with this invention, and FIG. 2 shows an embodiment of the jacking means.

Referring to FIG. 1 there is shown a reinforced bridge. The bridge includes a bridge span 2 composed of a plurality of intermediate units 3 and two end units 4. The end units 4 are supported by earthworks 5. The bridge span is reinforced by a bridge reinforcement which includes a reinforcing member 6 and two reinforcing struts 7. The member 6 comprises a chain of rigid elongate members 8. The members 8 are pivotally connected by links 9. The lower ends of the struts 7 are pivotally connected to the member 6 by means of links 9. The member 6 is provided with bifurcated ends and the branches of these ends are attached to the unions between the intermediate units 3 of the span 2. The bridge reinforcement further comprises jacking means for urging the strut 7 into its working position. In use the jacking means exerts a force transverse to the longitudinal axis of the strut 7. The jacking means includes a slideway 10 which is shown in FIG. 1. The slideway is attached to two adjacent unions. The jacking means is shown in greater detail in FIG. 2 and will now be described.

The jacking means comprises the slideway 10, a cable 11 and a jack 12 for hauling in the cable 11. The upper end of the strut 7 is provided with a slider block 13 for co-operation with the slideway 10. The jack 12 is rigidly mounted upon the slideway 10 and the cable 11 passes from the the jack around a pulley 14 to the slider block 13. The unions between the intermediate units 3 include pins 15 which stand proud of girders 17 of the intermediate units. The slideway 10 is attached to the pins 15 of two adjacent unions by means of clasps 16. Four such clasps are provided on the slideway and enable it to be mounted astride the girders 17. The clasps 16 include a static portion 18 welded to the slideway 10 and a resiliently biased hook 19 which is pivotally connected to the static portion 18. The hook 19 is resiliently biased, by means not shown, towards the static portion 18 such that the pin 15 is clasped. The means for biasing the hook 19 may be a coil spring but having regard to the environment in which bridge reinforcements are used it is preferable to use, instead of a coil spring, a block of rubber like material cemented to the hook 19 in such a position that it bears upon the static portion 18 to bias the hook towards it as foresaid. Preferably, to facilitate attachment of the slideway 10, the surfaces of the clasp 16 indicated in the figure by 20 are shaped such that when the slideway 10 is offered up to the span and the pin 15 contacts said surfaces 20 the hook 19 is initially urged, against its biasing, away from the static portion 18 and subsequently returns with a snap action to clasp the pin 15.

In use, the bridge reinforcement is added to the bridge under erection as is convenient. The form of the member 6 facilitates the addition of the reinforcement in that the rigid elongate members 8 and links 9 may be added progressively as the erection of the bridge proceeds. When the bridge is erected the member 6 may be tensioned by operating the jacks 12 to haul in the cables 11 thereby causing the slider blocks 13 to be slideably moved along the slideways 10. The struts 7 are thereby moved to their working positions.

Locking means for retaining the strut 7 in its working position is provided. The locking means comprises a pin 21, adapted at each of its ends to receive cotter pins 22, and pin receiving apertures 23. The strut 7 is moved to its working position by tensioning the cable 11 thereby urging the slider block 13 to a position to the right of the apertures 23. The slider block may be locked in that position by inserting the pin 21 into the apertures 23 and applying the cotter pins 22. When the tension in the cable 11 is released the left hand edge of the slider block 13 will abut and be retained by the pin 21.

It will be appreciated that a satisfactory bridge reinforcement may be provided, for one or both sides of a bridge, by employing one jacking means preferably positioned about the middle of the span 2. In such an embodiment the strut 7 may in its working position project normally from the span. Alternatively the bridge may be reinforced at one or both sides with a reinforcement as shown in FIG. 1.

What I claim is:

1. A bridge reinforcement for a bridge span, said reinforcement comprising a reinforcing member attachable to said bridge span at two longitudinally spaced locations, at least one slideway attachable to said bridge span at a location intermediate said spaced locations and disposable in a direction parallel with the longitudinal axis of said bridge span, a slider block slidable upon said slideway, a reinforcing strut having a first end adapted for pivotal connection to said slider block and a second end adapted for pivotal connection to said reinforcing member, and jacking means arranged to vary the position of said slider block with respect to said slideway, whereby in use, tension is adjustable in said reinforcing member via said reinforcing strut.

2. A bridge reinforcement according to claim 1 in which said slideway and said slider block are provided with coengagable locking means.

3. A bridge reinforcement according to claim 1 in which said jacking means includes a jack attached to said slideway and a cable attached between said slider block and said jack.

4. A bridge reinforcement according to claim 1 in which the reinforcing member comprises a chain of rigid elongate members.

5. A bridge reinforcement according to claim 4 in which the reinforcing member has bifurcated ends.

6. A bridge including a bridge span reinforced with a bridge reinforcement according to claim 1.

7. A bridge according to claim 6 in which the bridge span includes a plurality of intermediate units joined in end to end relationship by unions.

8. A bridge according to claim 7 in which the reinforcing member has bifurcated ends and each branch of the bifurcated ends of the member is attached to a union.

9. A bridge according to claim 7 in which said slideway is mounted upon the bridge span by attachment to two adjacent unions.

* * * * *